US006802789B1

(12) United States Patent
Ishino

(10) Patent No.: US 6,802,789 B1
(45) Date of Patent: Oct. 12, 2004

(54) VOLLEYBALL PRACTICE SYSTEM

(76) Inventor: Edmund S. Ishino, 6676 W. Leawood Dr., Littleton, CO (US) 80123

( * ) Notice: Subject to any disclaimer, the term of this patent is extended or adjusted under 35 U.S.C. 154(b) by 0 days.

(21) Appl. No.: 10/099,445

(22) Filed: Mar. 14, 2002

Related U.S. Application Data

(60) Provisional application No. 60/276,290, filed on Mar. 15, 2001.

(51) Int. Cl.[7] ..... A63B 69/00; A63B 61/00

(52) U.S. Cl. ..... 473/459; 473/460; 473/462; 473/490; 473/494; 273/401

(58) Field of Search ..... 473/459, 462, 473/422, 434, 435, 473, 465, 197, 472, 430–432, 476, 466, 467, 416, 492–495, 433; 273/392, 391, 401, 400, 348, 404, 407, 408; D21/799.1

(56) References Cited

U.S. PATENT DOCUMENTS 2,165,715 A * 7/1939 Moore ..... 220/277
3,215,432 A 11/1965 Lee et al.
3,563,544 A 2/1971 Hedrick
3,966,205 A 6/1976 Schain et al.
4,291,885 A * 9/1981 Cohen ..... 473/433
4,717,157 A * 1/1988 Smith ..... 473/494
4,852,876 A 8/1989 Scioscia
4,895,366 A * 1/1990 Bartasius ..... 273/402
5,062,646 A * 11/1991 Crist ..... 473/432
5,470,056 A * 11/1995 Dennesen ..... 473/462
5,472,212 A 12/1995 Bercaw
5,816,956 A * 10/1998 Ellis et al. ..... 473/490
5,827,137 A 10/1998 Ishino
5,947,831 A * 9/1999 McCarthy ..... 473/197
6,277,039 B1 * 8/2001 Kleinschrodt ..... 473/460
6,402,641 B1 * 6/2002 Lee ..... 473/446
6,659,893 B1 * 12/2003 Campbell et al. ..... 473/459

* cited by examiner

*Primary Examiner*—Stephen P. Garbe
*Assistant Examiner*—Mitra Aryanpour
(74) *Attorney, Agent, or Firm*—Ramon L. Pizarro; Edwin H. Crabtree

(57) ABSTRACT

A volleyball practice system that includes a generally rectangular first flexible panel supported from a pair of vertical supports, and at least one connector of adjustable length extending from at least one of the lower opposing corners of the first flexible panel. A second flexible panel that is smaller than the first flexible panel is supported in a generally parallel fashion from the first flexible panel. The first flexible panel extends below the second flexible panel, so that a trough area is created below the lower edge of the volleyball net when at least one of the lower opposing corners is suppported from the vertical supports.

14 Claims, 5 Drawing Sheets

VOLLEYBALL PRACTICE SYSTEM

REFERENCE TO RELATED APPLICATIONS

This application is a continuation of, and claims the benefit of, my provisional application having Ser. No. 60/276,290, filed Mar. 15, 2001, now abandoned.

BACKGROUND OF THE INVENTION (a) Field of the Invention

This invention generally relates to a volleyball or ball catching system. More particularly, but not by way of limitation, to a volleyball practice system that can be configured in various forms, such as to catch and return, hold, and drop a ball tossed against the system by a user.

(b) Discussion of Known Art

U.S. Pat. No. 5,827,137, incorporated herein in its entirety by reference, describes a portable volleyball practice apparatus. This practice apparatus includes a surface, such as a net, for catching a volleyball that is sent over a standard volleyball net or marker indicating the proper threshold for clearing a volleyball net. The surface impedes the flight of the ball and allows the ball to fall down near the net.

There remains a need for a device that allows the use of the catching net as a return mechanism, where the catching net accepts and allows the ball to roll back to the person hitting the ball. Also, there remains a need for a mechanism that allows a user to take a device such as my Portable Volleyball Practice Apparatus and quickly and inexpensively modify the device to achieve new and useful results, some of which have been described below. It will be understood that the disclosed invention allows the conversion of ordinary nets that are used for-catching into multi-functional net systems which have the capability to quickly convert from one configuration to another.

SUMMARY

It has been discovered that the problems left unanswered by known systems are solved by providing a set of connectors to a device, such as the device described in my U.S. Pat. No. 5,827,137. The connectors allow stretching and positioning of a catching component to achieve various functions. Preferably, the catching component will be a net or similar flexible sheet-like section with an upper border and a lower border. The disclosed connectors will be positioned on the lower border, and most preferably near a pair of lower corners of the catching component. The connectors will allow the catching component or net to cooperate with the volleyball net, or other component used to simulate a volleyball net to configure the catching component as a catch-and-hold device for catching and holding a ball. Also, the connectors will allow the catching component to be configured as a catch-and-return device that catches and directs the ball to roll back in a desired direction. Other configurations include functions as a target-rebound device and a catch and drop device.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

The accompanying figures show how to use disclosed components of the invention, including the use of a large net, or first flexible panel, capable of extending above and below a standard net or truncated volleyball net, or second flexible panel, and the unique attachments for changing configurations.

Catch and Hold Configuration

This configuration is achieved by connecting the lower opposing corners to the quick release link to stretch the first flexible panel-lower edge taut. This will form a fold or pouch or trough in the first flexible panel. The first flexible panel shall be behind the lower net with respect to the hitter. The hitter hits the ball into the first flexible panel and the ball will be directed down between the two nets and fall into the pouch and remain there.

Catch & Return Configuration

This configuration is achieved by supporting the lower opposing corners of the first flexible panel with a specific slackness. The upper net shall be behind the lower net with respect to the hitter. The hitter hits the ball into the upper net and the ball will be directed down between the two nets. The upper net redirects the downward momentum of the ball and returns the ball to the hitter.

Catch and Drop Configuration

This configuration is similar to the Catch & Return configuration, except that one or both of the lower opposing corners are disconnected and the ball will fall freely below and behind the nets.

Target Rebound Configuration

This configuration is achieved by using the first flexible panel as a backing panel behind the second flexible panel. The hitter hits the ball into the upper net and the ball rebounds directly back.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 7A:
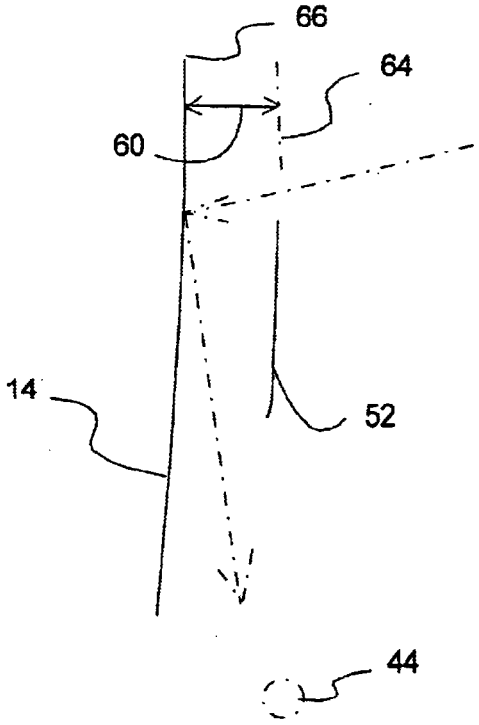

FIG. 7*a* illustrates cooperation of the volleyball to produce the catch and drop function.

Figure 7B:
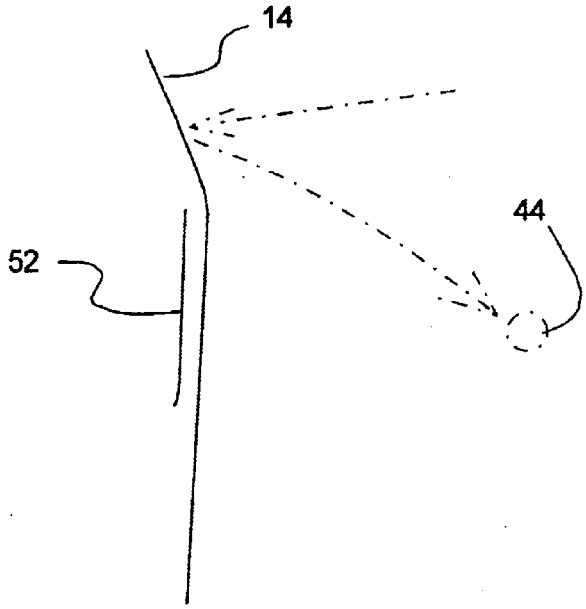

FIG. 7*b* illustrates the use the two flexible panel to produce the rebounding function.

Figure 7C:
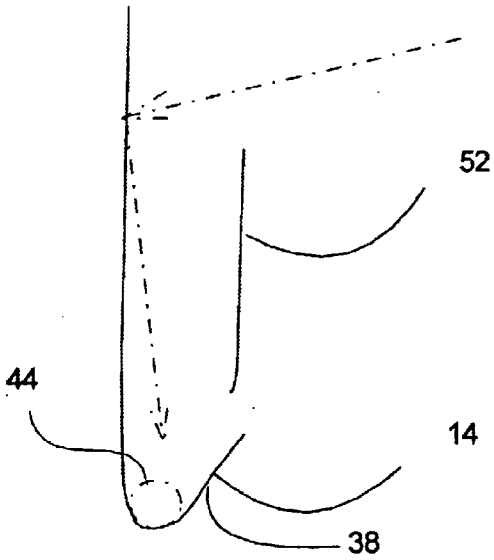

FIG. 7*c* illustrates the catch and hold function.

Figure 7D:
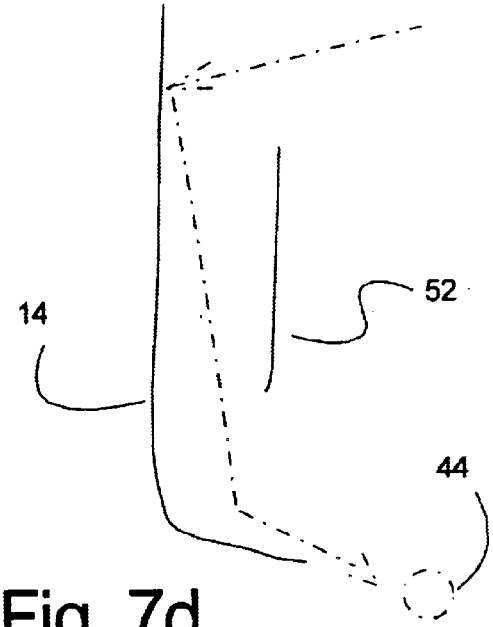

FIG. 7*d* illustrates the catch and return function.

Figure 8:
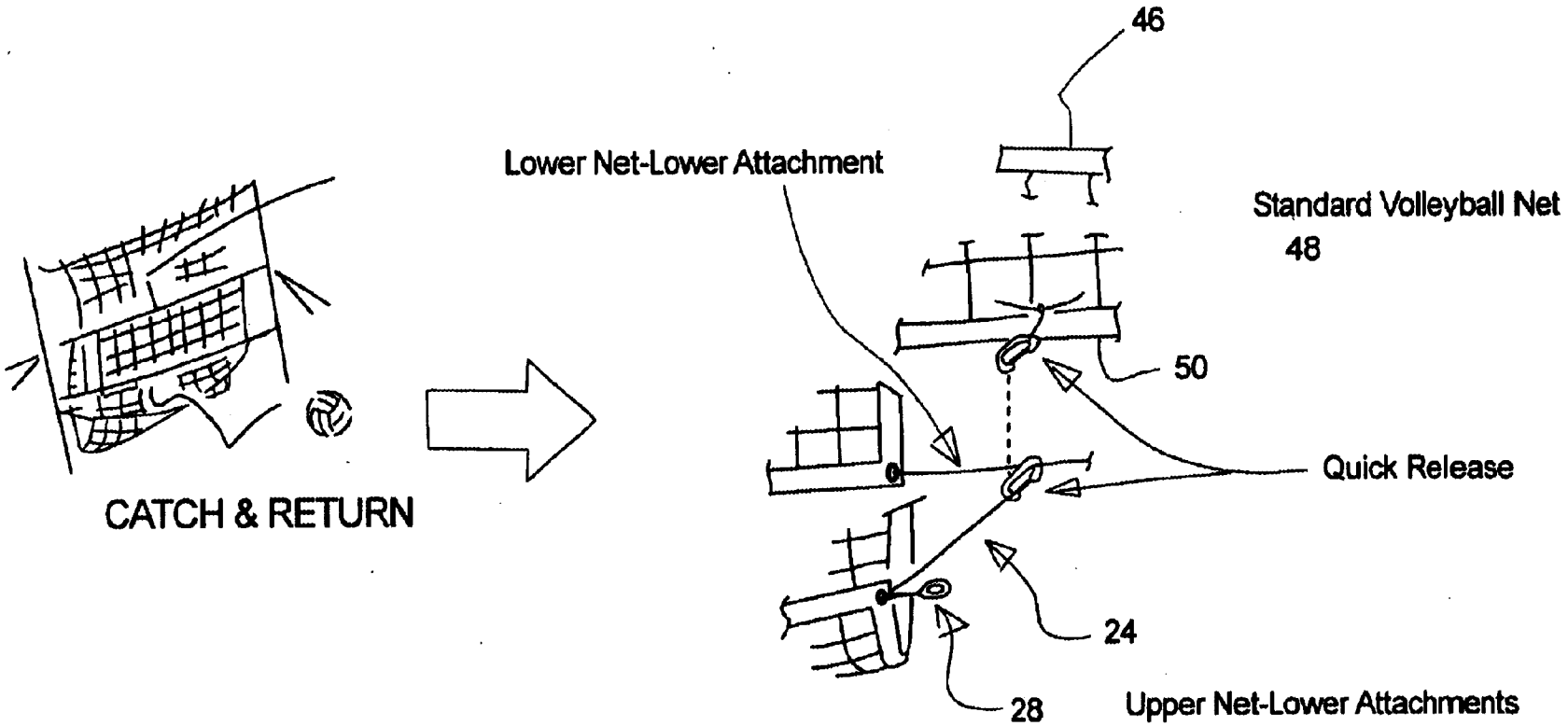

FIG. 8 illustrates the catch and return function.

Figure 9:
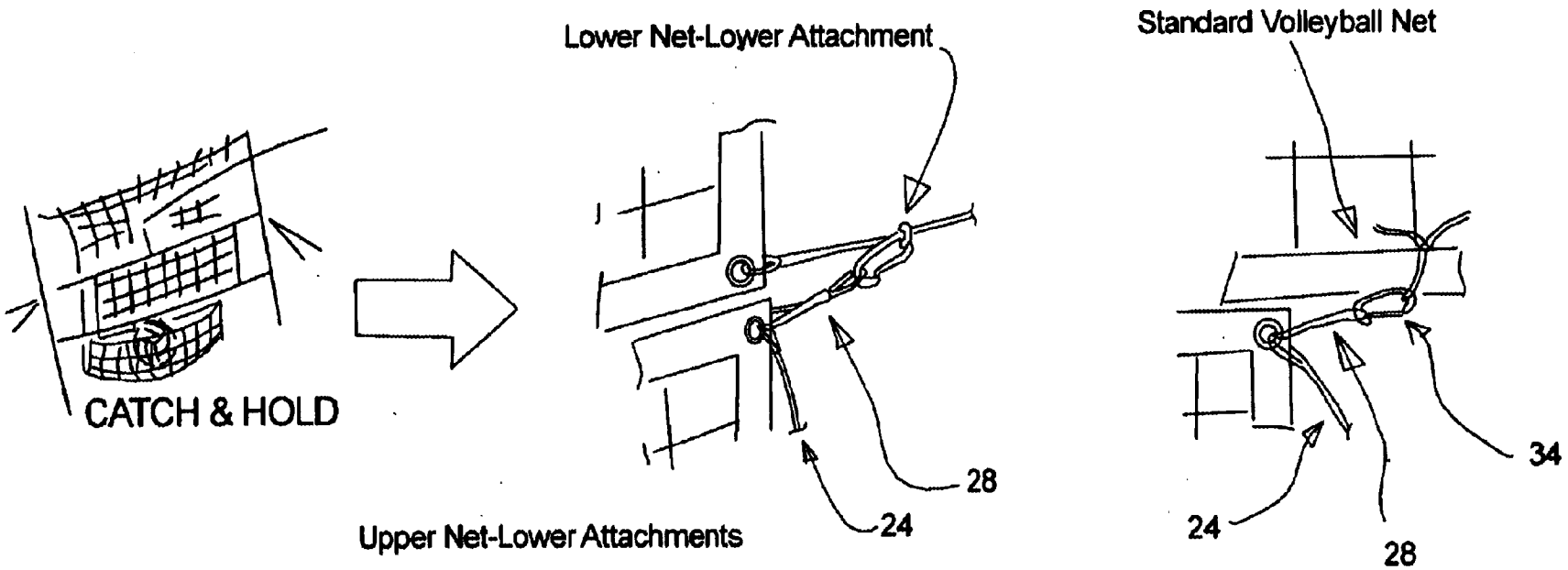

FIG. 9 illustrates the catch and hold function.

Figure 10:
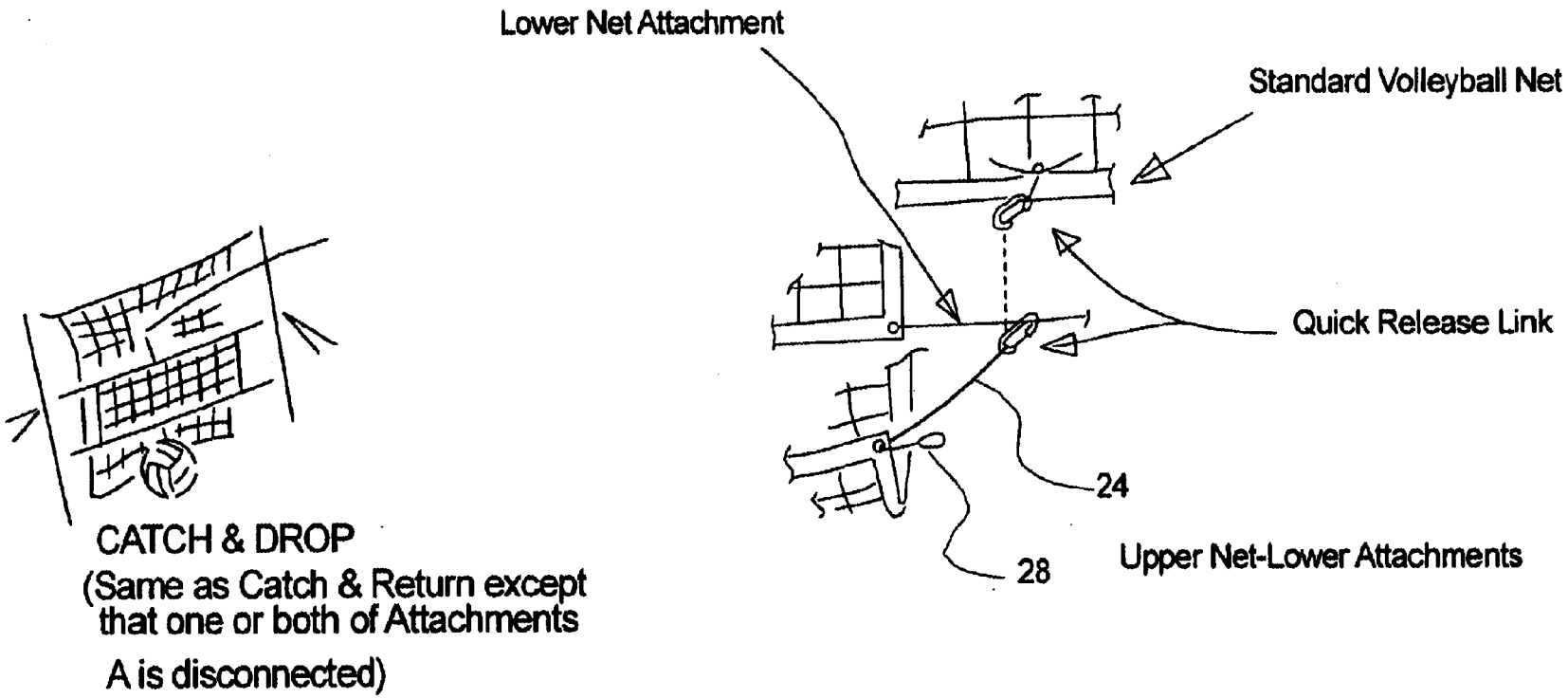

FIG. 10 illustrates the catch and drop function.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
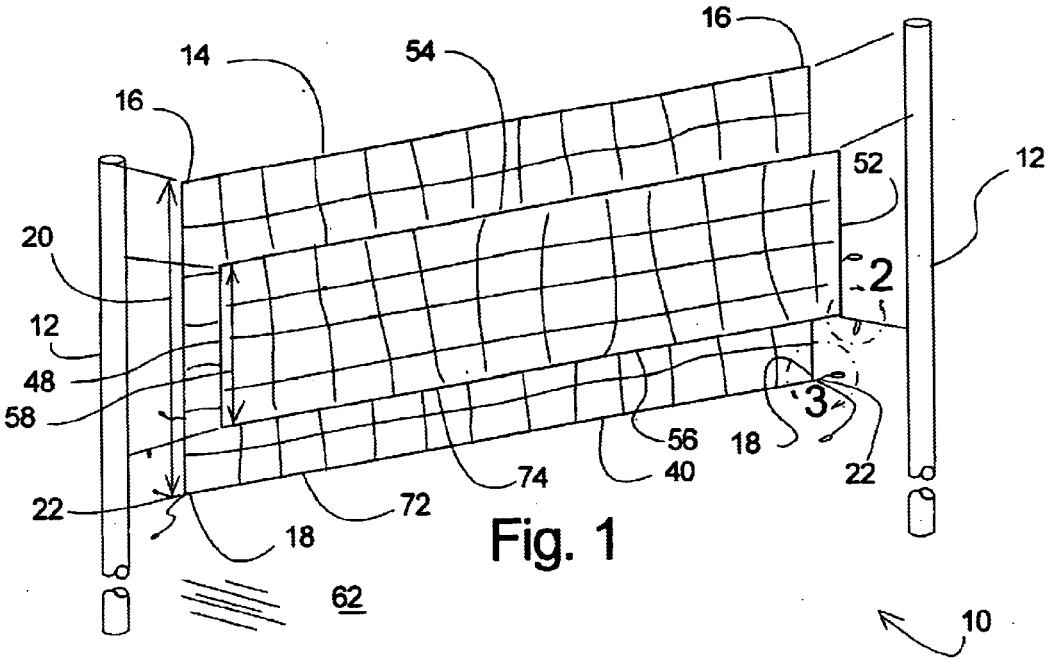
FIG. 1 is a perspective view of an embodiment of the invention in a catch and drop configuration with a first flexible panel and a second flexible panel supported from vertical supports.

Turning now to FIG. 1 where a volleyball practice system 10 has been illustrated mounted between a pair of vertical supports 12. The example illustrated in FIG. 1 includes a first flexible panel 14 that includes a pair of upper opposing corners 16 and a pair of lower opposing corners 18. The pair of lower opposing corners 18 are at a first distance 20 from the upper opposing corners 16. The pair of upper opposing corners 16 have been shown while being supported from the pair of vertical supports 12.

Figure 2:
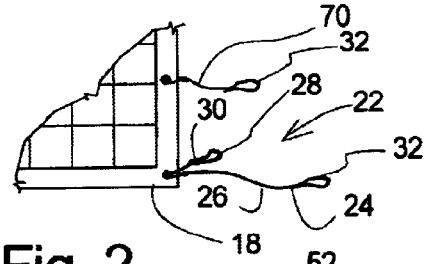
FIG. 2 shows a detail taken from FIG. 1, illustrating the first connector of adjustable length attached to one of the lower opposing corners.
Figure 3:
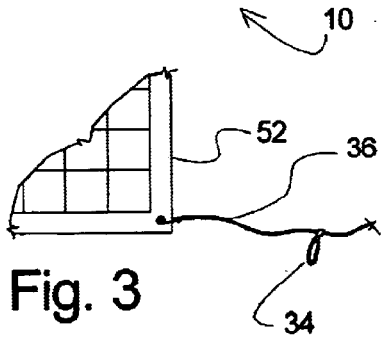
FIG. 3 illustrates the connection of the second flexible panel and the attachment of a quick disconnect connector to the line used to tighten the lower corners of the second flexible panel.
Figure 5:
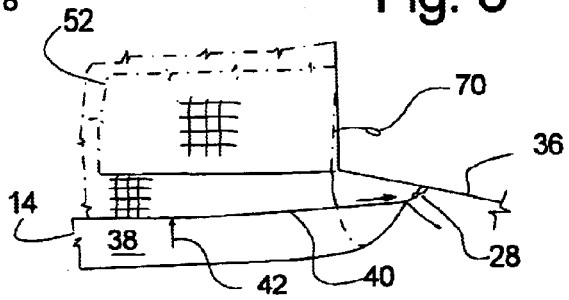
FIG. 5 illustrates the trough in the catch and hold arrangement.
Figure 4:
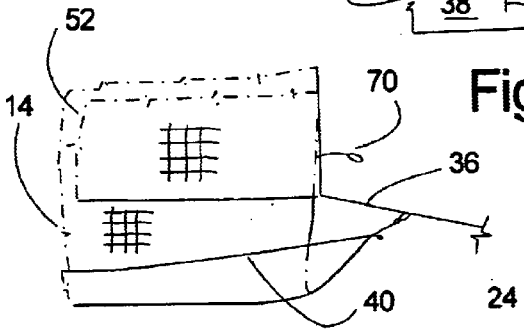
FIG. 4 illustrates the trough in the catch and return arrangement.
Figure 6:
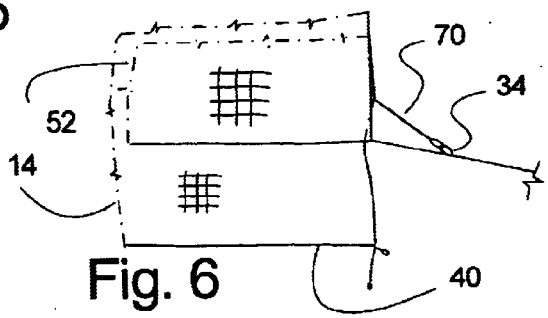
FIG. 6 illustrates the use of the two flexible panels to provide a rebound surface.

Turning now to FIGS. 2 and 3, it will be understood that at least one connector of adjustable length 22 will be attached to at least one of the lower opposing corners 18 of the first flexible panel 14. The length adjustment function of the connector of adjustable length 22 in the illustrated example is carried out by providing a first tether line 24 of a length 26 and a second tether line 28 of a length 30. The length 26 of first tether line 24 being greater, or longer, than the length 30 of the second tether line 28. The first tether line 24 and the second tether line 28 include a loop 32, ring, or other mechanism that cooperates with a quick release connector 34, such as a carabiner a snap hook, hook with a spring loaded gate, or other connector. The quick release connector 34 may be attached to a lower tension line 36, a volleyball net, or the vertical supports 12. Thus the connection of the first tether line 24 or the second tether line 28 to the quick release connector will vary the support geometry on the corresponding lower opposing corner 18. Thus, by attaching the second tether 28 to the quick release connector 34 one creates a trough 38 with a pronounced sidewall, meaning that the lower edge 40 of the first flexible panel 14 will be drawn taut and up, as indicated by the arrow 42.

By creating a high, taut, lower edge 40 on the trough 38, the disclosed invention can be used to catch and hold a ball 44 that strikes the first flexible panel 14, either by traveling over the upper edge 46 of a volleyball net 48 that may be used with the system 10, or under the lower edge 50 of the volleyball net 48. It is important to note that while it is contemplated that the disclosed system may cooperate with a volleyball net 48, it is also contemplated that the system may incorporate a second flexible panel 52 that is supported from the vertical supports 12, in a generally parallel manner at a distance from the first flexible panel 14.

When both panels are used, as illustrated in FIG. 1, it is contemplated that the second flexible panel 52 will include an upper edge 54 and a lower edge 56 that is approximately parallel to the upper edge 54 and at a second distance 58 or height from the upper edge 54. Additionally, the second flexible panel 52 will be supported at a panel distance 60 from the first flexible panel 14.

It is important to note that whether the system is used in conjunction with the second flexible panel 52 or with a volleyball net 48, the second distance 58, which is the vertical depth or height of the second flexible panel 52 material or the vertical depth or height of the volleyball net 48 material should be smaller than the first distance 20 of the first flexible panel 14. It is contemplated that the first flexible panel 14 material will be longer in a vertical direction than the second flexible panel 52 or the volleyball net in order to allow the lower edge 40 of the first flexible panel 14 to be curled up to form the trough area 38 created below the lower edge 50 of the volleyball net 48 or the lower edge 56 of the second flexible panel 52 when at least one of the lower opposing corners 18 is supported directly or indirectly from the vertical supports 12.

It is important note that by varying the degree of the curling up of the lower extremities of the first flexible panel 14 allows the user to form the trough 38 area, which allows the disclosed invention to produce important new and useful results. For example by using the first 13 tether instead of the second tether line 28 to support the lower opposing corners 18 directly or indirectly from the vertical supports 12, one can create a shallower trough area, with the lower edge 40 of the first flexible panel 14 held in a relatively slack manner. With this arrangement a ball 44 that is captured by the first flexible panel 4 will roll out of the trough 38 in the general direction of the person who drove the ball into the first flexible panel 14. This arrangement has been illustrated in FIGS. 7*d* and 8.

Thus, as shown on FIGS. 1, 4, 5 and 7*a*–7*d*, it is contemplated that the second flexible panel 52 will extend along a second panel plane 64, and the pair of upper opposing corners 16 of the first flexible panel 14 lie along a first flexible panel upper edge line 66, the first flexible panel upper edge line 66 being positioned in a generally parallel manner to the second panel plane 64.

Also illustrated in FIGS. 1, 2, and 4–6 is that it is further contemplated that the disclosed system will include a tension connector 70 that is attached to the first flexible panel 14 at a location between one of the pair of upper opposing corners 16 and the lower opposing corner directly below the one of the pair of upper opposing corners 16. The tension connector 70 may be adapted for attachment to the lower edge 50 of the volleyball net 48 to provide tension to the first flexible panel 14 between the tension connector 70 and the pair of upper opposing corners 16. This will reinforce or back-up the volleyball net 48 or second flexible panel 52, as illustrated in FIG. 1, so that a ball that is driven against these surfaces rebounds with a great proportion of the energy carried into the net or flexible panels.

Thus, in light of the above discussion, it will be understood that the first flexible panel 14 may be of a first panel width 72 and said second flexible panel 52 may be of a second panel width 74, with the first panel width 72 being approximate equal to the second panel width 74.

Still further it is contemplated that the first connector of adjustable length 22 may be a strap with a cinching or reeling mechanism that allows the strap to be lengthened or shortened to vary the depth and rigid y the trough 38 area. When using two tethers for the first connector of adjustable length, it is contemplated that one or both of the tethers may be of an elastic material that will stretch to allow access into the trough in order to retrieve the balls. Additionally, it is contemplated that this will allow tightening of one of the lower opposing corners 18 versus the other opposing corner 18 on the first flexible panel 14. This would direct the ball 44 to roll out of the trough 38 in the direction of the opposing corner 18 that is supported loosely, if supported at all.

It should be understood that it is contemplated that the disclosed invention may be configured to catch a volleyball, catch and return a volleyball, provide a backing or bouncing surface for target practice with a volleyball, or stop and drop a volleyball that is driven a volleyball net or a second flexible panel that simulates a volleyball net. Still further, it is contemplated that the vertical supports may be fixedly supported from the practice surface or supported from a portable support base that rests on the practice surface 62.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A volleyball practice system comprising:

a pair of vertical supports;

a generally planar volleyball net section that is of height, the volleyball net section being supported in a generally vertical manner from a practice surface, the volleyball net section further having an upper edge and a lower edge;

a first flexible panel, the first flexible panel having a pair of upper opposing corners and a pair of lower opposing corners, the pair of lower opposing corners being below the upper opposing corners at a distance from the upper opposing corners that is greater than the height of the volleyball net, so that the lower opposing corners lie below the lower edge of the volleyball net when the upper opposing corners are positioned above the upper edge of the volleyball net, the pair of upper opposing corners being adapted for being supported from the pair of vertical supports;

at least one connector of adjustable length extending from at least one of the lower opposing corners of the first flexible panel, so that a trough area is created with the first flexible panel, below the lower edge of the volleyball net by pulling up on the lower opposing corners with the at least one connector.

2. A volleyball practice system according to claim 1 wherein the volleyball net extends along a net plane, and said pair of upper opposing corners lie along a first flexible panel upper edge line, the first flexible panel upper edge line being adapted for being positioned in a generally parallel manner to the net plane.

3. A volleyball practice system according to claim 1 wherein said connector of adjustable length comprises a first tether line of a length and a second tether line of a length, the length of first tether line being greater than the length of the second tether line.

4. A volleyball practice system according to claim 1 and further comprising a tension connector, the tension connector being attached to the first flexible panel at a location between the upper one of the pair of upper opposing corners and the lower opposing corner directly below the one of the pair of upper opposing corners, the tension connector being adapted for attachment to the lower edge of the volley ball net to provide tension to the first flexible panel between the tension connector and the pair of upper opposing corners.

5. A volleyball practice system comprising:

a pair of vertical supports;

a first flexible panel, the first flexible panel having a pair of upper opposing corners and a pair of lower opposing corners, the pair of lower opposing corners being at a first distance from the upper opposing corners, the pair of upper opposing corners being supported from the pair of vertical supports, and at least one connector of adjustable length extending from at least one of the lower opposing corners of the first flexible panel;

a second flexible panel, the second flexible panel having an upper edge second and a lower edge that is approximately parallel to the upper edge of the second flexible panel and at a second distance from the upper edge of the second flexible panel, the second flexible panel being supported over a practice surface, said second distance being smaller than said first distance of said first panel, said upper opposing corners being positioned over said upper edge of said second flexible panel while said first flexible panel extends below the lower edge of the second flexible panel, so that a trough area is created by the first flexible panel below the lower edge of the volleyball net when at least one of the lower opposing corners is pulled up and supported from the vertical supports.

6. A volleyball practice system according to claim 5 wherein the second flexible panel extends along a second panel plane, and said pair of upper opposing corners of said first flexible panel lie along a first flexible panel upper edge line, the first flexible panel upper edge line being positioned in a generally parallel manner to the second panel plane.

7. A volleyball practice system according to claim 5 wherein said connector of adjustable length comprises a first tether line of a length and a second tether line of a length, the length of first tether line being greater than the length of the second tether line.

8. A volleyball practice system according to claim 5 wherein said first panel and said second panel are supported from said pair of vertical supports.

9. A volleyball practice system according to claim 8 wherein said first panel is of a first panel width and said second panel is of a second panel width, the first panel width being approximate equal to the first panel width.

10. A volleyball practice system according to claim 5 and further comprising a tension connector, the tension connector being attached to the first flexible panel at a location between the upper one of the pair of upper opposing corners and the lower opposing corner directly below the one of the pair of upper opposing corners, the tension connector being adapted for attachment to the lower edge of the volley ball net to provide tension to the first flexible panel between the tension connector and the pair of upper opposing corners.

11. A method for creating a volleyball practice system adapted for being supported from a pair of vertical supports over a practice surface, the practice system cooperating with a generally planar volleyball net that is supported in a generally vertical manner from a practice surface, the volleyball net having an upper edge and a lower edge, the method comprising:

providing a first flexible panel, the first flexible panel having a pair of upper opposing corners and a pair of lower opposing corners, the pair of lower opposing corners being below the upper opposing corners at a distance from the upper opposing corners, the distance being adapted for allowing the lower opposing corners to lie below the lower edge of the volleyball net when the upper opposing corners are positioned above the upper edge of the volleyball net;

supporting the pair of upper opposing corners from the pair of vertical supports, wherein the first flexible panel is connected at a higher position from the practice surface than the volleyball net;

attaching at least one connector of adjustable length, extending from at least one of the lower opposing corners; and forming a trough area below the lower edge of the volleyball net, when at least one of the lower opposing corners is supported from the vertical supports.

12. A method according to claim 11 wherein the volleyball net extends along a net plane, and said pair of upper opposing corners lie along a first flexible panel upper edge line, the first flexible panel upper edge line being adapted for being positioned in a generally parallel manner to the net plane.

13. A method according to claim 11 wherein said connector of adjustable length comprises a first tether line of a length and a second tether line of a length, the length of first tether line being greater than the length of the second tether line.

14. A method according to claim 11 and further comprising a tension connector, the tension connector being attached to the first flexible panel at a location between the upper one of the pair of upper opposing corners and at the lower opposing corner directly below the one of the pair of upper opposing corners, the tension connector being adapted for attachment to the lower edge of the volleyball net to provide tension to the first flexible panel between the tension connector and the pair of upper opposing corner.

* * * * *